US009797141B2

(12) United States Patent
Biron et al.

(10) Patent No.: US 9,797,141 B2
(45) **Date of Patent: *Oct. 24, 2017**

(54) LIGHT FIXTURE WITH PHOTOSENSOR-ACTIVATED ADJUSTABLE LOUVER ASSEMBLY

(71) Applicant: ABL IP Holding LLC, Conyers, GA (US)

(72) Inventors: Phoebus Biron, Sacramento, CA (US); James Mathew Ernst, Elk Grove, CA (US)

(73) Assignee: ABL IP Holding LLC, Decatur, GA (US)

( * ) Notice: Subject to any disclaimer, the term of this patent is extended or adjusted under 35 U.S.C. 154(b) by 139 days.

This patent is subject to a terminal disclaimer.

(21) Appl. No.: 14/730,565

(22) Filed: Jun. 4, 2015

(65) Prior Publication Data

US 2015/0354223 A1 Dec. 10, 2015

Related U.S. Application Data

(60) Provisional application No. 62/007,622, filed on Jun. 4, 2014.

(51) Int. Cl.
*F21S 8/04* (2006.01)
*F21S 11/00* (2006.01)
(Continued)

(52) U.S. Cl.
CPC ..... *E04D 13/033* (2013.01); *F21S 11/00* (2013.01); *F21V 11/04* (2013.01);
(Continued)

(58) Field of Classification Search
CPC . E04D 13/033; E04D 13/035; E04D 13/0352; E04D 13/0354; E04D 2013/034;
(Continued)

(56) References Cited

U.S. PATENT DOCUMENTS 3,902,056 A 8/1975 Aizenberg et al.
4,246,477 A 1/1981 Latter
(Continued)

OTHER PUBLICATIONS

Non-Final Office Action for U.S. Appl. No. 15/416,465, dated Jul. 3, 2017, 11 pages.

*Primary Examiner* — Peggy Neils
(74) *Attorney, Agent, or Firm* — Kilpatrick Townsend & Stockton LLP

(57) ABSTRACT

A light fixture delivers light to an illuminated space. The light fixture includes a housing that defines a skylight aperture therethrough, and movable louver blades coupled within and spanning the skylight aperture. Open, the louver blades do not substantially block light through the skylight aperture; closed, the louver blades block substantially all light through the skylight aperture. In intermediate positions, the louver blades block a portion of light through the skylight aperture. The light fixture also includes a dimmable artificial light source, integrated with the housing and configured to project light toward the illuminated space; a light sensor; and a control unit that is integrated with the housing and communicatively coupled with the light sensor. The control unit receives a signal from the sensor, and controls position of the louver blades and brightness of the artificial light source, in response to at least the signal from the light sensor.

15 Claims, 5 Drawing Sheets

(51) Int. Cl.

| | |
|---|---|
| ***E04D 13/03*** | (2006.01) |
| ***F21V 23/04*** | (2006.01) |
| ***F21V 11/04*** | (2006.01) |
| *F21Y 113/00* | (2016.01) |
| *F21Y 115/10* | (2016.01) |

(52) U.S. Cl.
CPC .. *F21V 23/0464* (2013.01); *E04D 2013/0345* (2013.01); *F21Y 2113/00* (2013.01); *F21Y 2115/10* (2016.08)

(58) Field of Classification Search
CPC ..... E04D 2013/0345; F21V 11/04; F21V 23/0464; E04F 19/02; F21S 11/00; F21S 8/04; F21Y 2115/10; F21Y 2113/20
See application file for complete search history.

(56) References Cited

U.S. PATENT DOCUMENTS 4,351,588 A 9/1982 Zullig
4,539,625 A 9/1985 Bornstein et al.
4,576,440 A 3/1986 Worthington
5,099,622 A 3/1992 Sutton
5,528,471 A 6/1996 Green
5,581,447 A 12/1996 Raasakka
5,716,442 A 2/1998 Fertig
5,896,712 A 4/1999 Chao
5,896,713 A 4/1999 Chao et al.
6,035,593 A 3/2000 Chao et al.
6,142,645 A 11/2000 Han
6,219,977 B1 4/2001 Chao et al.
6,363,667 B2 4/2002 O'Neill
6,363,668 B2 4/2002 Rillie et al.
6,381,070 B1 4/2002 Cheng
6,528,782 B1 3/2003 Zhang et al.
7,057,821 B2 * 6/2006 Zincone ..... E04D 13/033 136/246
7,146,768 B2 12/2006 Rillie
7,234,279 B2 6/2007 Sincic et al.
7,322,156 B1 1/2008 Rillie et al.
7,546,709 B2 6/2009 Jaster et al.
7,621,081 B2 11/2009 Rillie
7,638,743 B2 12/2009 Bartol et al.
7,639,423 B2 12/2009 Kinney et al.
7,736,014 B2 6/2010 Blomberg
7,781,713 B2 8/2010 Papamichael et al.
7,875,252 B2 1/2011 Ma et al.
7,976,189 B2 7/2011 Osborn
7,995,277 B2 8/2011 Patterson
8,018,653 B2 9/2011 Jaster
8,068,282 B1 11/2011 Kastner et al.
8,082,705 B2 12/2011 Jaster et al.
8,083,363 B2 12/2011 Jaster
8,098,433 B2 1/2012 Rillie et al.
8,104,921 B2 1/2012 Hente et al.
8,111,460 B1 2/2012 Huang
8,132,375 B2 3/2012 Jaster
8,139,908 B2 3/2012 Moyer
8,313,224 B2 11/2012 Moyer
8,371,078 B2 2/2013 Jaster
8,455,807 B2 6/2013 Sun et al.
8,459,851 B2 * 6/2013 Wemmer ..... F21S 11/00 362/183
8,568,011 B2 10/2013 Rillie et al.
8,569,977 B2 10/2013 Lanham et al.
8,601,757 B2 12/2013 Jaster et al.
8,622,560 B2 1/2014 Di Trapani et al.
8,746,942 B2 6/2014 Bracale
8,779,681 B2 * 7/2014 Adler ..... F21S 2/00 315/291
8,837,048 B2 9/2014 Jaster
8,896,924 B2 11/2014 Weaver
8,955,269 B2 2/2015 Rillie
8,958,157 B2 2/2015 Rillie et al.
8,982,467 B2 * 3/2015 Jaster ..... F21S 11/00 359/592
9,027,292 B2 5/2015 O'Neill et al.
9,052,452 B2 6/2015 Maxey
9,074,742 B1 7/2015 Petrocy et al.
9,101,011 B2 8/2015 Sawada et al.
9,127,823 B2 9/2015 Jaster
9,146,012 B2 9/2015 Bartol et al.
9,202,397 B1 12/2015 Petrocy et al.
9,210,768 B2 * 12/2015 Adler ..... H05B 33/0857
9,291,321 B2 3/2016 Jaster
9,322,525 B2 4/2016 Gommans et al.
9,416,940 B2 8/2016 Di Trapani et al.
2002/0060283 A1 5/2002 Jordan et al.
2007/0273290 A1 11/2007 Ashdown et al.
2010/0039799 A1 2/2010 Levens
2010/0103655 A1 4/2010 Smith
2011/0242810 A1 10/2011 Lopez Querol et al.
2012/0087113 A1 * 4/2012 McClellan ..... E04D 13/03 362/147
2013/0002144 A1 1/2013 Adler
2013/0083554 A1 4/2013 Jaster
2013/0293963 A1 11/2013 Lydecker
2014/0233256 A1 8/2014 Orfield
2014/0362567 A1 12/2014 Dobbertin et al.
2015/0035440 A1 2/2015 Spero
2015/0061500 A1 3/2015 Yeh
2015/0362143 A1 12/2015 Baaijens et al.
2015/0369434 A1 12/2015 Baaijens et al.
2015/0377435 A1 12/2015 Liu et al.
2016/0033100 A1 2/2016 Hansson
2016/0153194 A1 6/2016 Kristensen
2016/0153631 A1 6/2016 Chen
2016/0169465 A1 6/2016 Jones et al.
2017/0071046 A1 3/2017 Petschulat et al.

* cited by examiner

FIG. 5
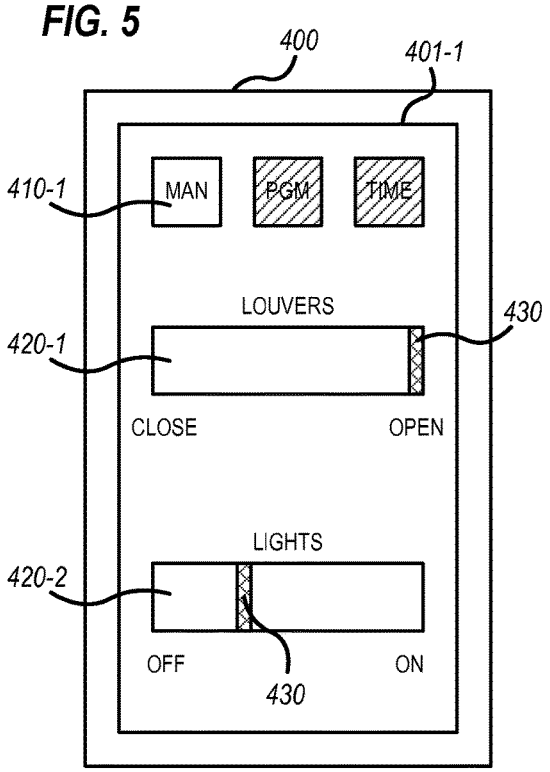
FIG. 6
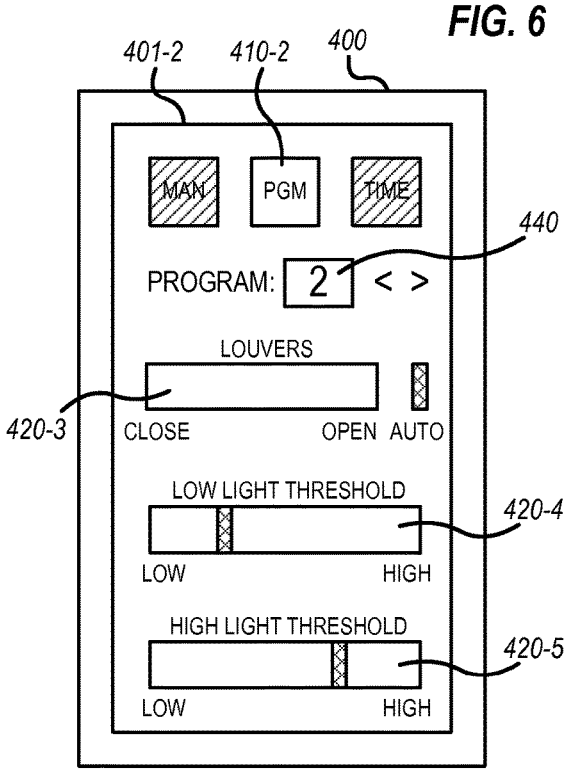
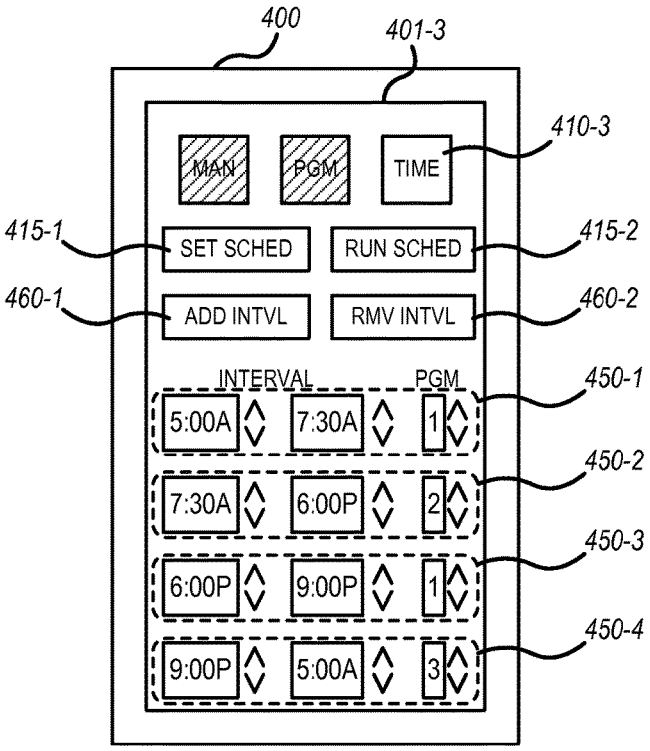
FIG. 7

LIGHT FIXTURE WITH PHOTOSENSOR-ACTIVATED ADJUSTABLE LOUVER ASSEMBLY

CROSS REFERENCE TO RELATED APPLICATION

This application claims the benefit of U.S. Provisional Patent Application No. 62/007,622, filed Jun. 4, 2014, which is incorporated by reference herein.

FIELD OF THE INVENTION

This invention relates to skylights, light fixtures, and control of light levels internal and external to structures.

BACKGROUND

Skylights have long been used in buildings to transmit light through roofs and other structures, but the level of light in the building often is not controlled or must be controlled using manually operated shutters or louvers.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In an embodiment, a light fixture delivers light to an illuminated space. The light fixture includes a housing that defines a skylight aperture therethrough, and a plurality of movable louver blades coupled to the housing and spanning the skylight aperture defined in the housing. In an open position, the louver blades do not substantially block light from passing through the skylight aperture. In a closed position, the louver blades block substantially all light from passing through the skylight aperture. In a plurality of intermediate positions between the open position and the closed position, the louver blades block a portion of light from passing through the skylight aperture. The light fixture also includes: a dimmable artificial light source that is integrated with the housing about a lower perimeter of the skylight aperture and that is configured to project artificial light toward the illuminated space; a light sensor that detects light illuminating the space and provides a signal in response thereto; and a control unit that is integrated with the housing and is communicatively coupled with the light sensor. The control unit receives the signal from the light sensor, and controls position of the louver blades and brightness of the dimmable artificial light source, in response to at least the signal from the light sensor.

BRIEF DESCRIPTION OF THE DRAWINGS

Illustrative embodiments herein are described in detail below with reference to the following drawings:

FIG. 5 is a view of the face of an exemplary user control panel, illustrating manual controls for use with the light fixture of FIG. 2, in an embodiment.

FIG. 6 is another view of the face of the exemplary user control panel, illustrating programming features for use with the light fixture of FIG. 2, in an embodiment.

FIG. 7 is another view of the face of the exemplary user control panel, illustrating scheduling features for use with the light fixture of FIG. 2, in an embodiment.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Among other purposes, the purposes of this invention are to:

A. Balance lighting in a specified space during daylight hours.

B. Control the amount of daylight entering a specified space.

C. Restrict the amount artificial light exiting a specified space and illuminating outer areas of a building, causing light nuisance for the surrounding or outer areas.

D. Accomplish objectives A, B, and C above in a single light fixture assembly, to minimize installation time and cost, as at least one option.

Figure 1:
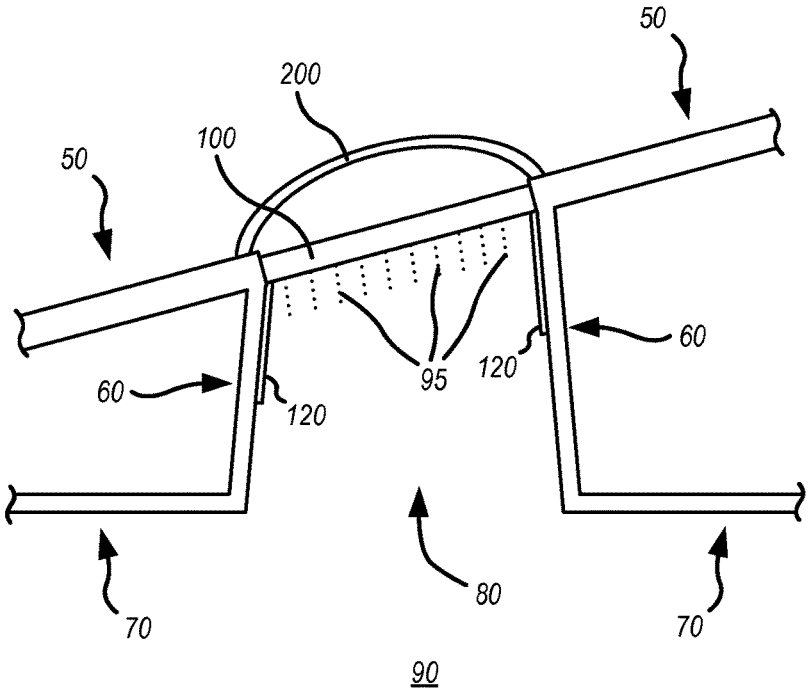
FIG. 1 is a cross sectional view of a portion of a structure illustrating a light fixture installed therein, according to an embodiment.

FIG. 1 is a cross sectional view of a portion of a structure, illustrating a light fixture 100 installed therein. Light fixture 100 is described further below. A roof 50 defines a skylight that is covered by a skylight cover 200. Light fixture 100 mounts within roof 50 at the skylight. Wall portions 60 typically adjoin and extend from roof 50 toward ceiling portions 70, which define a ceiling aperture 80 for light to enter an illuminated space 90 beneath the skylight. Wall portions 60 may be reflective, and/or a reflective lining 120 may be installed that extends from a lower side thereof toward the ceiling aperture, to increase an amount of light 95 that reaches ceiling aperture 80 and passes into illuminated space 90. However, wall portions 60 and ceiling portions 70 may not exist in all cases, that is, light fixture 100 can be installed in locations wherein roof 50 is directly above illuminated space 90. Light 95 passes through light fixture 100 and/or is emitted by an artificial light source within light fixture 100, as described below, toward illuminated space 90. Advantageously, light fixture 100 is a compact unit that can be installed in existing roof skylight openings and can provide light and lighting control for skylights of a variety of interior shapes and sizes. That is, light fixture 100 does not require mechanical alignment or operational coordination of different portions at the roofline and down to the ceiling aperture, and can be utilized in skylights of any orientation (e.g., generally horizontal, sloped or even vertical). Light fixture 100 can be of many sizes and shapes, but for compatibility with typical roof construction, is generally four to six inches deep (see also FIG. 9).

Figure 2:
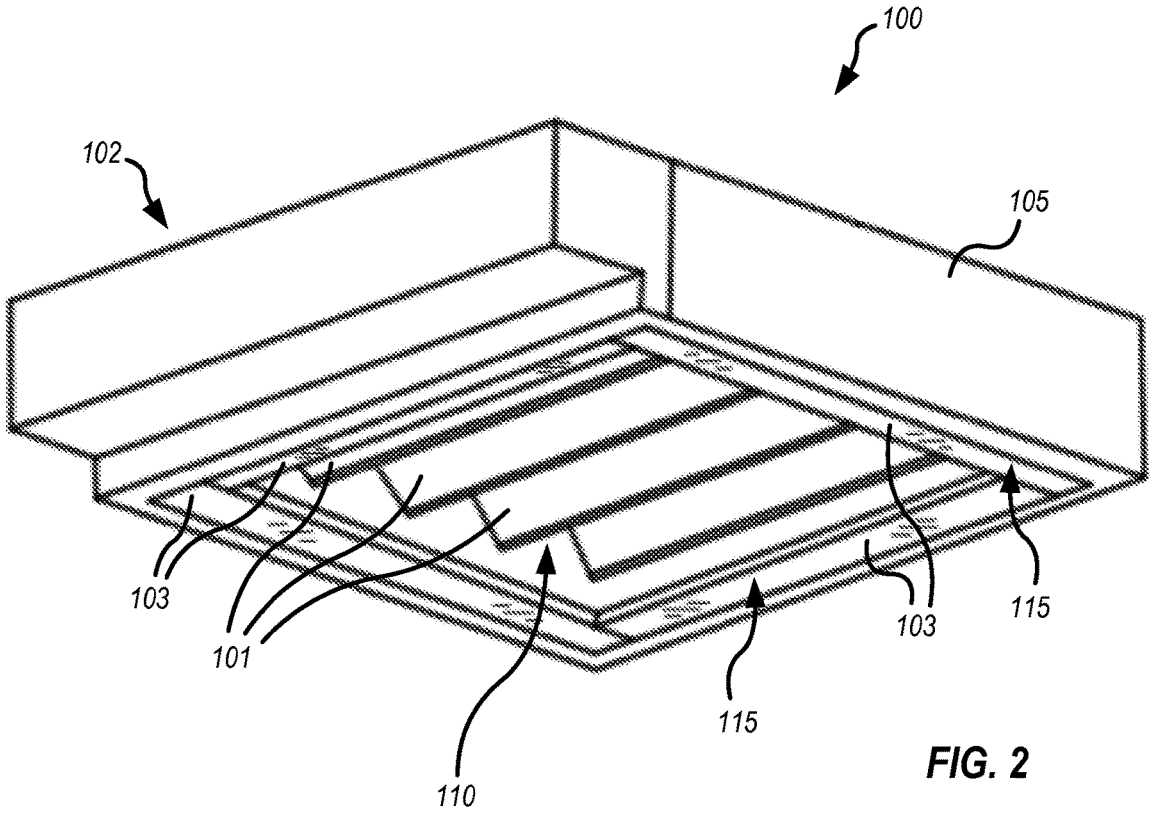
FIG. 2 is an isometric view of an underside and two sides of a light fixture, in an embodiment.

FIG. 2 is an isometric view of an underside and two sides of a light fixture 100. Light fixture 100 may be controlled manually or automatically, as discussed below. Light fixture 100 includes a housing 105 that defines a skylight aperture 110 therein. Louver blades 101 are coupled within and span skylight aperture 110, as shown. Housing 105 may be substantially rectilinear, as illustrated in FIG. 2 and elsewhere, such that louver blades 101 may be simple straight, flat shapes of identical length that each extend across skylight aperture 110; however in certain embodiments, housing 105 and/or skylight aperture 110 are not rectilinear, and louver blades 101 may have differing shapes and/or lengths so as to span skylight aperture 110 completely. Louver blades 101 are actuated by a control unit 102 and help control or restrict the amount of light (e.g., either daylight or artificial light) going through skylight aperture 110 in either direction. That is, as discussed below, louver blades 101 can be closed to prevent nuisance light or light pollution from exiting a structure in which light fixture 100 is installed. Louver blades 101 may be driven by either a DC, Stepper, Servo or similar motorized device which communicates through a motor controller/driver and lighting controller combination, identified in FIGS. 2 and 3 as control unit 102. Louver blades 101 may be provided with reflective upper and/or lower surfaces; reflective lower surfaces help to reflect light downward into an illuminated space 90 when blades 101 are closed, to maximize light to the illuminated space 90. Similarly, reflective upper surfaces may reflect at least a portion of natural light that would otherwise enter skylight aperture 110 (that is not captured for lighting purposes) upwardly, to reduce heat retention on sunny, bright days. Although not illustrated as such herein (and not required), light fixture 100 is typically installed within a skylight in a structure, to control natural light coming through the skylight to an illuminated space, and to provide artificial light as needed to supplement the natural light.

Light fixture 100 also includes a dimmable artificial light source 103. In embodiments, light source 103 includes a plurality of light-emitting diodes (LEDs) or other dimmable light emitters. The light emitters are typically disposed along one or more sides of housing 105 and are oriented so that they project emitted light away from light fixture 100 toward illuminated space 90. One or more optional diffusers 115 may be integrated with housing 105 and are disposed so as to diffuse the emitted light (e.g., in the orientation shown in FIG. 2, diffusers 115 are disposed beneath the light emitters).

Figure 3:
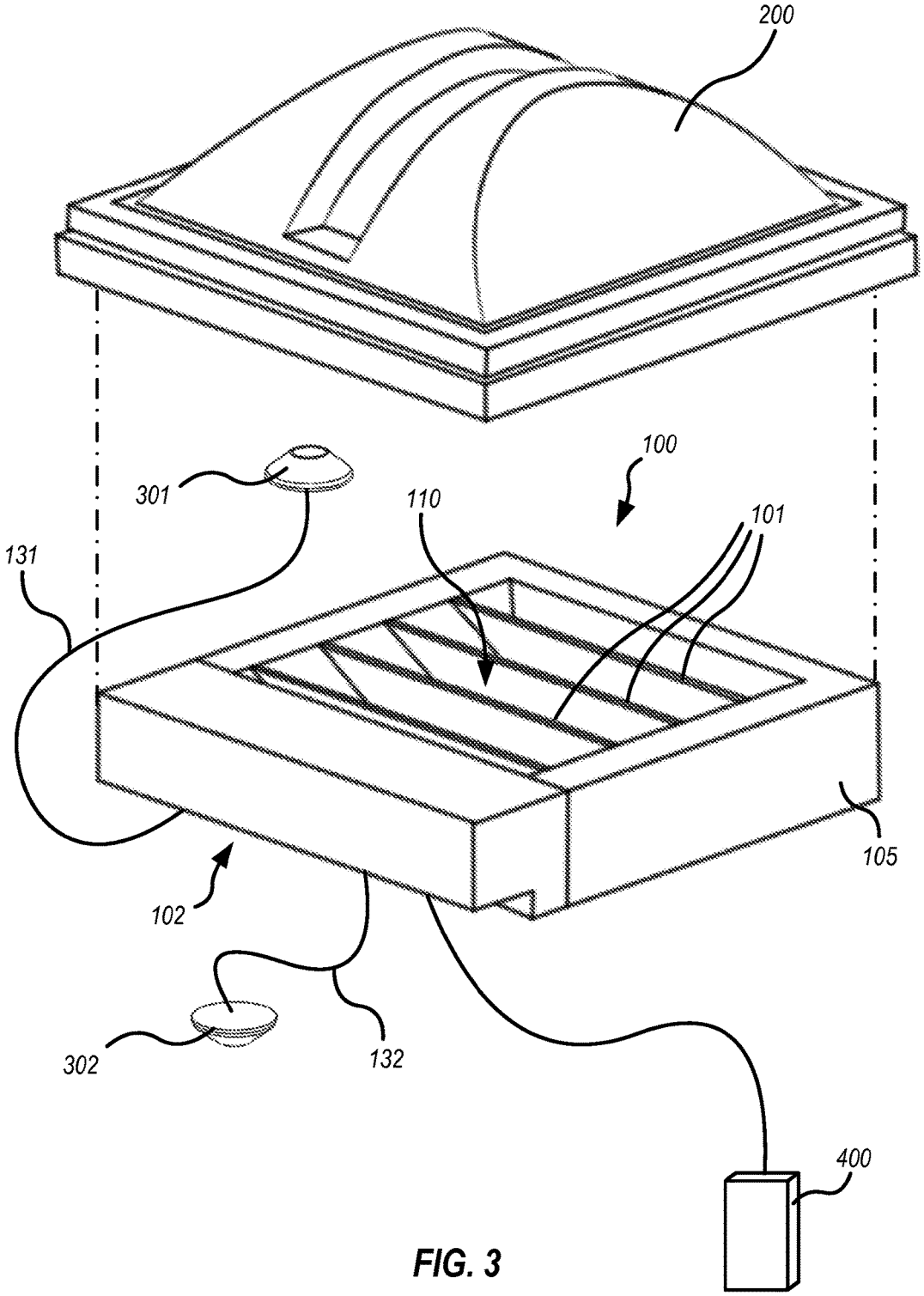
FIG. 3 is an exploded, schematic view of an upper side and two sides of the light fixture shown in FIG. 2, in an embodiment, together with a skylight cover, light sensors and a user control panel.

FIG. 3 is an exploded, schematic view of an upper side and two sides of light fixture 100 (FIG. 2) together with an optional skylight cover 200, light sensors 301, 302 and a user control panel. Relative sizes of light fixture 100, skylight cover 200 and light sensors 301, 302 are not necessarily drawn to scale. Also, although light sensors 301, 302 are shown as discrete elements, other forms of integration are possible; in embodiments, either or both of light sensors 301, 302 are integrated with light fixture 100. Control unit 102 of light fixture 100 is communicatively coupled with light sensors 301, 302. FIG. 3 illustrates light sensors 301, 302 being connected with control unit 102 using wires 131, 132 respectively, but other forms of connectivity are possible; in embodiments, either or both of light sensors 301, 302 connect with control unit 102 using wireless forms of communication (e.g., WiFi, Bluetooth, etc.) instead of with wires 131, 132. Light sensor 301 detects an amount of light entering an open orifice of a roof, such as through skylight cover 200. Light sensor 302 detects an amount of light within a space illuminated by light fixture 100. Each of light sensors 301, 302 provides a signal in response to detected light, and is communicatively coupled with control unit 102. Light sensor 301 will typically face upward, but may be reoriented as necessary to provide a useful indication of natural light. In embodiments, light sensor 302 may face downward, as suggested by its illustration in FIG. 3, and thus capture light reflected from the space being lit by light fixture 100; but in other embodiments light sensor 302 may face upward, essentially measuring light provided by light fixture 100 directly and irrespective of reflection from the illuminated space.

Control unit 102 is connected to a user control panel 400 that is accessible to a user. User control panel 400 may include mechanical or electrical switches, and may provide digital or analog input to control unit 102. In embodiments, user control panel 400 provides one or more of manual control, setup of programs, and execution of specified programs for the user. Certain such programs, and components of control unit 102 that implements the programs, are described below.

Figure 4:
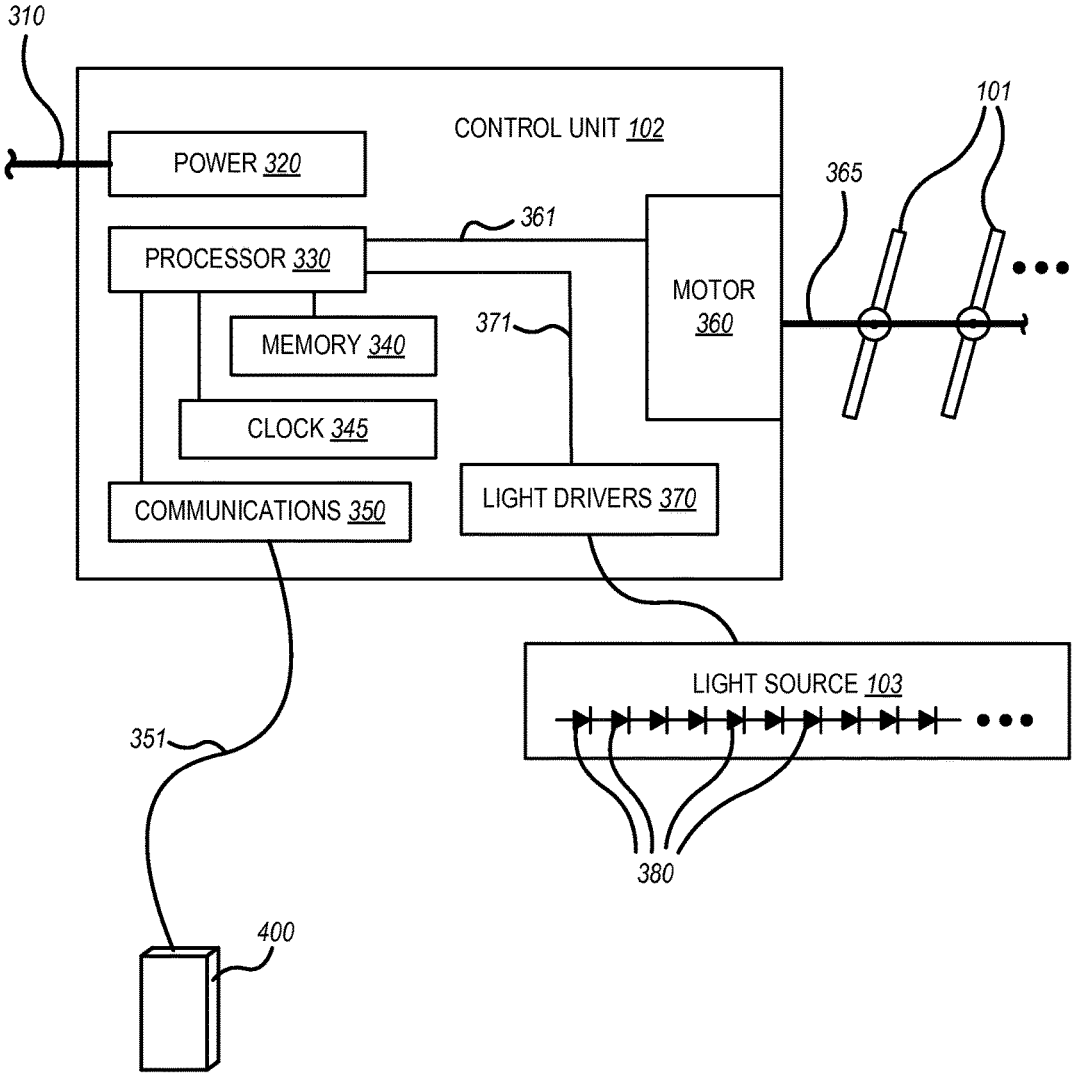
FIG. 4 is a schematic diagram that illustrates components of the control unit of the light fixture of FIG. 2, in an embodiment.

FIG. 4 is a schematic diagram that illustrates components of control unit 102 and how it provides control over key elements of light fixture 100 (FIGS. 2 and 3). Control unit 102 includes power conditioning circuitry 320 that receives external power 310 and provides appropriately conditioned power to other components within light fixture 100, light source 103, and, optionally, user control panel 400. For example, power conditioning circuitry 320 may convert 120 VAC line voltage provided as external power 310 to DC power and provide one or more low voltage DC power supplies for various components as needed. Power connections from power conditioning circuitry 320 to other components are not shown, for clarity of illustration.

Control unit 102 includes a processor 330, a memory 340, optional clock circuit 345, communications circuitry 350, a motor 360, and light drivers 370. Memory 340 stores programs, settings and optionally schedules that can be set up by users using user control panel 400. Processor 330 executes the programs, utilizes the settings and schedules, and provides commands to motor 360 and light drivers 370 for operation of louver blades 101 and light source 103, respectively. Motor 360 includes circuitry as necessary to provide voltage and/or current based on motor commands 361, and drives a mechanical linkage 365 that operates louver blades 101. Light drivers 370 are circuits that provide appropriate voltage and/or current based on light commands 371, to drive light source 103. Light source 103 is shown in FIG. 4 as including a plurality of light emitting diodes (LEDs) 380 connected in series, but it should be understood that any type of dimmable light source and any manner of electrical connectivity may be used as light source 103.

In embodiments, optional clock circuit 345 enables control unit to provide a time based mode in which factory-set or user-defined programs run according to time of day, day of week, and the like. In these embodiments, user control panel 400 enables a user to set clock circuit 345 with the current time, which it maintains thereafter, and to specify intervals during which each program should run.

Control unit 102 communicates with user control panel 400 through communications circuitry 350. A connection 351 shown in FIG. 4 may be a physical wire or cable (e.g., a single or multi-strand conductor suitable for implementing any direct electrical connection protocol) or may be a wireless connection such as WiFi, Bluetooth and the like. FIG. 5 is a first view of the face of user control panel 400, illustrating manual controls for use with light fixture 100 (FIG. 2). FIG. 6 is a second view of the face of user control panel 400, illustrating programming features for use with light fixture 100. FIG. 7 is a third view of the face of user control panel 400, illustrating scheduling features for use with light fixture 100. FIGS. 5, 6 and 7 show user control panel 400 with exemplary screens 401-1, 401-2 and 401-3, respectively, which may be collectively referred to as screens 401. Control panel 400 may be implemented as a physical control unit or remote control that is wired to light fixture 100, or may communicate wirelessly thereto; in particular control panel 400 may be implemented using touch-screen technology on a dedicated control unit or on a user device such as a smartphone or tablet. In embodiments, screens 401-1, 401-2 and 401-3 may be alternate presentations provided on a screen of a physical unit or user device; alternatively, these screens and/or features thereof may be available simultaneously. Many options for providing equivalent or similar functionality will become apparent to those skilled in the relevant art. Screens 401-1, 401-2 and 401-3 are now described in sufficient detail as to enable implementation of control panels with equivalent or similar functionality.

Screen 401-1, FIG. 5, shows control panel 400 in a selected "manual" mode indicated by appearance of a feature 410-1, which may be a physical button or an icon on a touch-screen. In embodiments, the mode of operation is selected by tapping feature 410-1, causing it to have an appearance indicating the selected mode while causing other features to have an appearance indicating they are not selected. Beneath these features are slider or switch controls 420-1 (labeled "LOUVERS") and 420-2 (labeled "LIGHTS"); hereafter termed "slider controls" 420, notwithstanding that mechanical switches (e.g., potentiometers) may be used to provide such functionality. Using slider control 420-1, a user may set louver blades 101 (by moving a slider bar 430) to fully open or closed positions, or any setting in between, using the controls. Similarly, using slider control 420-2, the user may set the artificial light to a full on, off, or any dim setting in between, using a slider bar 430. This gives the user countless combinations of Daylighting and Artificial Lighting combinations. Slider controls 420-1 and 420-2 can be touch-screen features or mechanical switches that provide similar functionality, or can be replaced by other means for indicating values such as "open," "closed," "on," "off" and intermediate values.

Screen 401-2, FIG. 6, shows control panel 400 in a selected "program" mode indicated by appearance of a feature 410-2, which may be a physical button or an icon on a touch-screen. Screen 401-2 allows a user to create programs and/or to customize pre-installed programs. In embodiments, these programs cause control unit 102 to monitor the amount of light provided in a designated space (through a signal from light sensor 302, FIG. 3) and adjust the louver blades 101 and artificial light source 103 accordingly, to illuminate the space at a specific light level, as desired by the user.

In screen 401-2, a feature 440 indicates a specific program being created and/or customized. The user may provide a louver setting using a slider control 420-3, or may set slider control 420-3 to an alternative, "AUTO" setting that gives control unit 102 latitude to adjust louver settings according to light signal from sensor 301 (FIG. 3). The user determines an amount of light required in a specified space, and indicates this desire using slider controls 420-4 and 420-5 to set a low light threshold and/or an optional high light threshold respectively. In embodiments, control unit 102 operates artificial light source 103 while the user operates slider controls 420-4 and 420-5, so that the user can experience the light level being requested.

Programs created and/or customized by a user using control panel 400 may not include all of the possible settings shown in FIG. 6, and/or may include additional settings. For example, screen 401-2 does not include a slider indicating light to be provided by artificial light source 103, because it runs light source 103 based on low and high light levels; however, explicit control of light source 103 could be included. Similarly, controls or switches indicating a desired operation without respect to light levels (for example, a "don't care" with respect to signals from light sensors 301, 302) are possible.

In operation of certain program embodiments, light sensor 301 determines an amount of natural light available to illuminate the specified space, while light sensor 302 determines the amount of light actually provided to the specified space. A low daylight threshold for natural light may be factory-set, or may be provided by a user with screens or controls like those illustrated in screens 401-1, 401-2. Many programs will typically be set up such that when light sensor 301 does not detect outside light, control unit 102 will close louver blades 101 to avoid light pollution caused by light from artificial light source 103 (or other light sources of the illuminated space) exiting through skylight aperture 110. In this case, artificial light source 103 is turned on and increased in brightness until the signal from light sensor 302 indicates that the low light threshold is met.

If the signal from light sensor 301 indicates that there is at least some natural light available, control unit 102 will open louver blades 101 at least partially, and continue to open them until the signal from light sensor 302 indicates that the low light threshold is met, or until louver blades 101 are fully open. If louver blades 101 are fully open but the signal from light sensor 302 does not indicate that the low light threshold is met, artificial light source is turned on and increased in brightness until the signal from light sensor 302 indicates that the low light threshold is met. Automatic adjustment of artificial light source so that the signal from light sensor 302 remains above the low light threshold is referred to as "servo" operation below. For energy efficiency, preference is normally given to maximum use of natural light to meet the low light threshold before artificial light source 103 is used, but control panel 400 can override this preference if desired by the user. In some embodiments, a high light threshold is provided using slider control 420-5, and a program that includes the high light threshold will not only turn off artificial light 103 completely, but will partially close louver blades 101 until the signal from light sensor 302 indicates that the light in the space lit by light fixture 100 is less than the high light threshold. Operation of louver blades 101 in this mode is referred to as "servo" operation below.

In other embodiments, programs can provide settings for louver blades 101 and artificial light source 103 that do not monitor or adjust operation according to light levels.

Various programs may be created and/or customized through the use of control panel 400. Examples of some such programs are listed in Table I below, but these are not an exclusive or exhaustive list. Many other program types and settings will become evident to one skilled in the art upon reading and comprehending the present specification and drawings.

Program 1, designated "On/twilight" is set to allow daylight, if present, into the space illuminated by light fixture 100, to close louver blades 101 to prevent light pollution if daylight is not present, and to keep artificial light source 103 off for energy savings. Program 2, designated "On/normal" is set to close louver blades 101 if dark outside, to open louver blades 101 if natural light is present, and to coordinate actions of louver blades 101 and artificial light source 103 to provide comfortable light levels, giving preference to natural light for energy savings. Program 3 is an "Off" program that simply closes louver blades 101 and turns off artificial light source 103 regardless of light levels.

Program and light level definitions for Table I below are as follows. "Area light" is defined as a light level determined by evaluation of a signal from the area illuminated (e.g., from sensor 302). A "Low" Area light level means light level determined from sensor 302 is below a low light threshold (typically customizable by a user, see FIG. 6). A "Mid" Area light level means light level determined from sensor 302 is above the low light threshold, but below a high light threshold. A "High" Area light level means light level determined from sensor 302 is above the high light threshold. "Natural light" is defined as a light level determined by evaluation of a signal from outside (e.g., from sensor 301). A "Dark" Natural light level means light level determined from sensor 301 is below a low daylight threshold. A "Light" Natural light level means light level determined from sensor 301 is above the low daylight threshold.

TABLE I

Exemplary program settings

| Program nbr/type | Area light | Natural light | Louver Control | Light Control |
|---|---|---|---|---|
| 1 On/twilight | Don't care | Dark | Closed | Off |
| | Don't care | Light | Open | Off |
| 2 On/normal | Low | Dark | Closed | Servo |
| | Mid | Dark | Closed | Servo |
| | High | Dark | Closed | Servo |
| | Low | Light | Open | Servo |
| | Mid | Light | Servo | Servo |
| | High | Light | Servo | Off |
| 3 Off | Don't care | Don't care | Closed | Off |

Screen 401-3, FIG. 7, shows control panel 400 in a selected "time" mode indicated by appearance of a feature 410-3, which may be a physical button or an icon on a touch-screen. Screen 401-3 allows a user to create and/or to customize a schedule that switches among programs according to time of day, day of week, and the like. Screen 401-3 illustrates how programs may be designated to operate during four daily time intervals, the start time, end time and program number for each interval being designated as 450-1, 450-2, 450-3 and 450-4 respectively. A user may use feature 415-1 to put control panel 400 into a "Set schedule" mode to allow changes to the schedule, and may use feature 415-2 to put control panel 400 into a "Run schedule" mode to begin operation according to the schedule. In the "Set schedule" mode, program intervals can be added or removed from the schedule by using the "Add interval" and "Remove interval" features 460-1 and 460-2, respectively. The user can select a desired number of intervals, create or adjust starting and stopping times of each interval, and associate a program with each interval.

Figure 8:
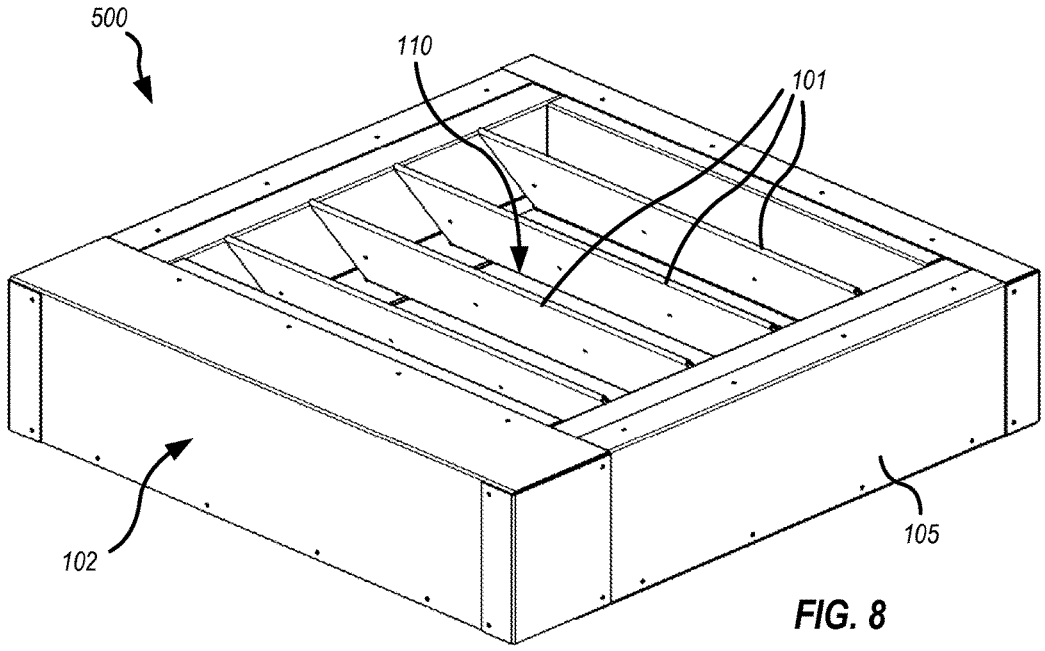
FIG. 8 is an engineering drawing of an embodiment of this invention similar to the light fixture embodiment shown in FIG. 3.

FIG. 8 is an engineering drawing of a light fixture 500 in a view that is similar to the view of light fixture 100, FIG. 3.

Figure 9:
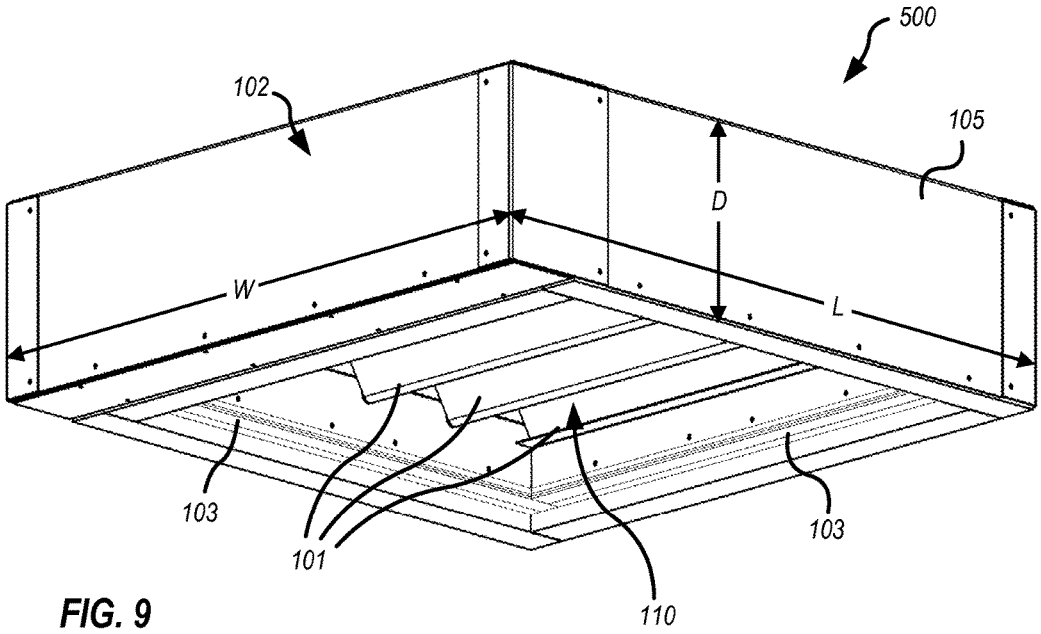
FIG. 9 is an engineering drawing of an embodiment of this invention similar to the embodiment shown in FIG. 2.

FIG. 9 is an engineering drawing of light fixture 500 in a view that is similar to the view of light fixture 100, FIG. 2. Directions of width W, length L and depth D are noted in FIG. 9. As discussed above, embodiments such as light fixture 500 can be of many sizes. Depth D is typically less than seven inches and is usually four to six inches. Width W is typically about 18 inches to about six feet, while length L is typically about 18 inches to about ten feet.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A light fixture that delivers light to an illuminated space, comprising:

a housing that defines a skylight aperture therethrough;

a plurality of movable louver blades coupled to the housing and spanning the skylight aperture defined in the housing, wherein:

in an open position, the louver blades do not substantially block light from passing through the skylight aperture, in a closed position, the louver blades block substantially all light from passing through the skylight aperture, and in a plurality of intermediate positions between the open position and the closed position, the louver blades block a portion of light from passing through the skylight aperture;

a dimmable artificial light source that is integrated with the housing about a lower perimeter of the skylight aperture and that is configured to project artificial light toward the illuminated space;

a light sensor that detects light illuminating the space and provides a signal in response thereto; and a control unit that is integrated with the housing and is communicatively coupled with the light sensor, wherein the control unit:

receives the signal from the light sensor, and controls position of the louver blades and brightness of the dimmable artificial light source in response to at least the signal from the light sensor.

2. The light fixture of claim 1, wherein:

the control unit includes a processor and a memory;

the memory stores a plurality of programs; and at least a first one of the programs is configured to open the louver blades when the signal indicates light from the illuminated space is below a low light threshold.

3. The light fixture of claim 2, wherein the first one of the programs is further configured to increase brightness of the dimmable artificial light source when the signal indicates light from the illuminated space is below the low light threshold.

4. The light fixture of claim 2, wherein the first one of the programs is further configured to turn off the dimmable artificial light source when the signal indicates light from the illuminated space is above a high light threshold.

5. The light fixture of claim 4, wherein the first one of the programs is further configured to close the louver blades to one of the plurality of intermediate positions, when the signal indicates light from the illuminated space is above the high light threshold.

6. The light fixture of claim 2, wherein at least a second one of the programs is configured to turn off the dimmable artificial light source and close the louver blades without regard to the signal.

7. The light fixture of claim 6, wherein the control unit includes a real time clock and is configured to implement the first one of the programs during a first time of day and to implement the second one of the programs during a second time of day.

8. The light fixture of claim 1, wherein the light sensor is a first light sensor and the signal is a first signal and wherein the light fixture further comprises:

a second light sensor disposed opposite the louver blades from the illuminated space and communicatively coupled with the control unit, wherein the second light sensor detects natural light and provides a second signal in response thereto.

9. The light fixture of claim 8, wherein the control unit is configured to close the louver blades to prevent light pollution when the second signal indicates the natural light is below a minimum daylight threshold.

10. The light fixture of claim 1, wherein the housing is substantially rectilinear.

11. A light fixture that delivers light to an illuminated space, comprising:

a housing that defines a skylight aperture therethrough, wherein the housing has a depth of less than seven inches;

a plurality of movable louver blades coupled to the housing and spanning the skylight aperture defined in the housing, wherein:

in an open position, the louver blades do not substantially block light from passing through the skylight aperture, in a closed position, the louver blades block substantially all light from passing through the skylight aperture, and in a plurality of intermediate positions between the open position and the closed position, the louver blades block a portion of light from passing through the skylight aperture;

a dimmable artificial light source that is integrated with the housing about a lower perimeter of the skylight aperture and that is configured to project artificial light toward the illuminated space;

a light sensor that detects light illuminating the space and provides a signal in response thereto; and a control unit that is integrated with the housing and is communicatively coupled with the light sensor, wherein the control unit:

receives the signal from the light sensor, and controls position of the louver blades and brightness of the dimmable artificial light source in response to at least the signal from the light sensor.

12. The light fixture of claim 1, wherein the housing is configured for installation within a skylight opening within a roof of a structure, the roof being directly above the illuminated space, and wherein the housing is not configured to form mechanical connections with the structure below the skylight opening.

13. The light fixture of claim 1, further comprising a reflective lining extending from a lower side of the housing toward the illuminated space.

14. The light fixture of claim 1, wherein the dimmable artificial light source comprises a plurality of LEDs integrated with the housing about the lower perimeter of the skylight aperture.

15. The light fixture of claim 14, wherein:

the lower perimeter of the skylight aperture comprises four sides;

the plurality of LEDs comprises four subsets, each subset of the LEDs being integrated with a respective one of the four sides; and further comprising a diffuser that is integrated with the housing and disposed beneath the plurality of LEDs.

* * * * *